US007017956B2

(12) United States Patent
Kogami

(10) Patent No.: US 7,017,956 B2
(45) Date of Patent: Mar. 28, 2006

(54) LOCK MECHANISM AND OPENING-CLOSING DEVICE

(75) Inventor: Mitsuru Kogami, Utsunomiya (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 10/721,089

(22) Filed: Nov. 26, 2003

(65) Prior Publication Data

US 2004/0140675 A1 Jul. 22, 2004

(30) Foreign Application Priority Data

Jan. 22, 2003 (JP) ..... 2003-013307

(51) Int. Cl.
*E05C 3/16* (2006.01)

(52) U.S. Cl. ..... 292/224; 292/222; 292/341.15; 292/DIG. 4

(58) Field of Classification Search ..... 292/341.15, 292/DIG. 4, 197–198, 203, 224, 341.17, 292/222
See application file for complete search history.

(56) References Cited

U.S. PATENT DOCUMENTS

| | | | | |
|---|---|---|---|---|
| 3,156,493 | A * | 11/1964 | Griffiths | 292/341.15 |
| 3,785,004 | A * | 1/1974 | Stoffregen | 292/DIG. 4 |
| 4,368,937 | A * | 1/1983 | Palombo et al. | 312/325 |
| 4,669,764 | A * | 6/1987 | Bruck | 292/341.17 |
| 4,792,165 | A * | 12/1988 | Nishimura | 292/DIG. 4 |
| 5,040,833 | A * | 8/1991 | Brunnert | 292/DIG. 4 |
| 5,050,922 | A * | 9/1991 | Falcoff | 292/DIG. 4 |
| 5,144,963 | A | 9/1992 | Dabringhaus et al. | |
| 5,211,430 | A * | 5/1993 | Chern | 292/DIG. 4 |
| 5,211,431 | A * | 5/1993 | Koizumi et al. | 292/DIG. 4 |
| 5,217,262 | A * | 6/1993 | Kurosaki | 292/DIG. 4 |
| 5,498,039 | A * | 3/1996 | Bivens | 292/DIG. 4 |
| 5,997,056 | A * | 12/1999 | Yamagishi | 292/341.17 |
| 6,056,333 | A * | 5/2000 | Wach | 292/DIG. 4 |
| 6,247,733 | B1 * | 6/2001 | Weiland | 292/341.17 |
| 6,290,281 | B1 * | 9/2001 | Durrani et al. | 292/341.17 |
| 6,592,385 | B1 * | 7/2003 | Chen | 439/159 |
| 6,669,250 | B1 * | 12/2003 | St. Louis | 292/341.17 |
| 2002/0096892 | A1 | 7/2002 | Sato et al. | |
| 2002/0171251 | A1 | 11/2002 | Bieck et al. | |

FOREIGN PATENT DOCUMENTS

| | | |
|---|---|---|
| DE | 44 27 768 | 11/1995 |
| GB | 2 117 472 | 10/1983 |
| GB | 2 207 002 | 1/1989 |
| GB | 2 261 698 | 12/1994 |
| JP | 7-215117 | 8/1995 |
| JP | 11-245733 | 9/1999 |

* cited by examiner

*Primary Examiner*—Brian E. Glessner
*Assistant Examiner*—Christopher Boswell
(74) *Attorney, Agent, or Firm*—Manabu Kanesaka

(57) ABSTRACT

A lock mechanism includes a cam provided on one of a base member and a movable member and having a swing groove around a roughly heart-shaped projecting portion; a swing member pivotally provided on the other of the base member and the movable member and having a pin for tracing along the swing groove; and an auxiliary device provided on a side where the cam is disposed for contacting and separating from the swing member to restrict an unnecessary movement of the swing member while the pin is tracing the swing groove. In the lock mechanism, when the movable member is pushed against a force of an urging device, the movable member is locked at the first position through the swing groove and the pin. When the movable member is pushed again, the movable member is released and switched from the first position to the second position.

9 Claims, 8 Drawing Sheets

(b)

LOCK MECHANISM AND OPENING-CLOSING DEVICE

BACKGROUND OF THE INVENTION AND RELATED ART STATEMENT

The present invention relates to a lock mechanism for locking a movable member relative to a base member against a force of urging means. The lock mechanism is a push and push type (also referred to as a push-lock and push-open type) in which the movable member is locked through a first pushing operation and is released through the next pushing operation. The present invention also relates to a opening-closing device of a movable member with the lock mechanism.

Japanese Patent No. 3,126,992 has disclosed a lock mechanism including a striker provided on one of a movable member and a base member, and a latching device provided on the other of the movable member and the base member. The latching device includes a latching member with a swing groove, a spring member, and a pin. FIGS. 8(*a*)–8(*c*) show another structure including a cam provided on one of the movable member and the base member and having a swing groove; and a swing member movably provided on the other of the movable member and the base member and including a pin for tracing the swing groove. The latter mechanism is superior to the former due to a smaller number of components and a lower switching noise.

Patent reference 1 has disclosed a lock mechanism shown in FIG. 8(*a*). In the lock mechanism, a movable member (box) rotates in a vertical direction relative to a base member (case on a ceiling side of a car compartment). An upper end of a swing member 60 is supported on the base member through an axis 62, and a pin 61 projects at a lower end of the swing member 60. A cam 50 is provided on the movable member, and a swing groove 51 is formed around a roughly heart-shaped projecting portion 52. The swing groove 51 includes a guide groove 51*a* extending to a lower right side from an upper side; a guide groove 51*b* and a guide groove 51*d* situated below the guide groove 51*a*; an engagement groove 51*c* located at an upper side between the guide grooves 51*b* and 51*d*; and a return groove 51*e* extending to an upper side from the guide groove 51*d*.

When the movable member is pushed to rotate toward the base member with the cam 50 against an urging force, the pin 61 moves to the guide groove 51*b* from the guide groove 51*a*. When the movable member is released, the pin 61 moves from the guide groove 51*b* to the engagement groove 51*c*. When the movable member is pushed and released again, the pin 61 moves from the engagement groove 51*c* to the guide groove 51*d*, and enters the return groove 51*e*. As a result, the movable member is switched in a direction away from the base member through the urging force and its own weight. In the lock mechanism, the swing member 60 is in a suspended state and moves right and left around the axis 62, so that the pin 61 does not receive an excessive load.

Patent reference 2 has disclosed a lock mechanism shown in FIG. 8(*b*). In the lock mechanism, a movable member (inner case such as an ashtray) is rotated relative to the base member (outer case mounted to a car chamber panel). A swing member (lock main member) 65 includes a first elastic portion 67 supported on the base member through an axis 66 at a lower end; a second elastic portion 68 extending toward both sides above the elastic portion 67; and a pin 69 projecting at an upper end. A cam 55 is provided on the movable member and includes a swing groove 56 around a roughly heart-shaped projecting portion 57. The swing groove 56 includes a guide groove for introduction, a guide groove for engagement, a guide groove for release, an engagement groove, and a return groove (reference numerals omitted). The movable member is locked and released through a process same as that of the lock mechanism shown in FIG. 8(*a*). In the lock mechanism, the first elastic portion 67 is urged to press the pin 69 against a slope of the engagement groove, and the second elastic portion 68 is urged to press the pin 69 against a slope of the return groove through the swing member 65, respectively. Accordingly, it is possible to stably maintain the lock mechanism in an engagement state and prevent an excessive movement of the swing member 65.

Patent reference 1; Japanese Patent Publication (Kokai) No. 11-245733

Patent reference 2; Japanese Patent Publication (Kokai) No. 07-215117

In the lock mechanisms described above, the swing members 60 and 65 are provided on the base member, and the cams 50 and 55 are provided on the movable member. It is also possible to provide the swing members and the cams in the opposite way. Depending on shapes and sizes of the base member and the movable member, when the swing member is provided on the base member, the lock mechanism becomes complicated. In some cases, it is easier to simplify the lock mechanism when the cam is provided on the base member.

However, the conventional lock mechanisms have the following problems when the swing member is provided on the movable member. First, it is necessary to movably support the swing member for securing a smooth movement of the pin. Considering its own weight, it is necessary to arrange the swing member at a certain position relative to the movable member.

FIG. 8(*c*) is a schematic view of a modified version of the lock mechanism shown in FIG. 8(*a*), in which the cam 50 is provided on the base member, and the swing member 60 is provided on the movable member. The swing member 60 rotates along with the movable member around the axis 62. Accordingly, when the pin 61 moves from the guide groove 51*b* to the engagement groove 51*c*, the swing member 60 reenters the guide groove 51*a* through the guide groove 51*b* by the weight of the swing member 60, i.e. a downward momentum, thereby preventing a normal operation. In a case of the structure shown in FIG. 8(*b*), the swing member 65 becomes complicated due to the elastic portions 67 and 68. It is also difficult to provide a contacting portion on the movable member for receiving the elastic portions 67 and 68, thereby limiting a space for installation.

In view of the problems described above, an objective of the present invention is to provide a lock mechanism with a simple arrangement and a minimum installation space even when a swing member is provided on a movable member, thereby preventing a wrong operation of a pin and making a design flexible.

Further objects and advantages of the invention will be apparent from the following description of the invention.

SUMMARY OF INVENTION

In order to achieve the objects described above, according to the present invention, a lock mechanism includes a cam provided on one of a base member and a movable member and including a swing groove around a roughly heart-shaped projecting portion; an swing member movably provided on the other of the base member and the movable member and including a pin for tracing along the swing groove; and auxiliary means provided on a side where the cam is disposed for contacting and separating from the swing member to restrict an unnecessary movement of the swing member while the pin is tracing the swing groove. In the lock mechanism, when the movable member is pushed against a force of urging means, the movable member is locked at the first position through the swing groove and the pin. When the movable member is pushed again, the movable member is released and switched from the first position to the second position.

In the present invention, when the pin is tracing the swing groove accompanied by a swing motion of the swing member, the auxiliary means contacts and separates from a part of the swing member to control the swing member to move properly. For example, the cam may be disposed nearly sideways relative to the base member. In this case, when the pin moves from the guide groove to the engagement groove, or from the guide groove to the return groove, the pin moves downwardly due to a downward momentum of the swing member, thereby causing a wrong operation. It is possible to easily and reliably prevent the wrong operation when the auxiliary means contacts the swing member to restrict the movement of the swing member by its own weight.

In the present invention, the auxiliary means is a member independent of the swing member and provided on the side same as that of the cam. Therefore, the auxiliary means has a simple structure and is flexible with respect to an installation space. Also, the auxiliary means is easily attached, and does not excessively restrict the movement of the swing member since the auxiliary means contacts and separates from the swing member. It is also possible to reduce a switching noise due to the contacting force and the frictional force of the pin relative to the swing groove.

According to the present invention, the auxiliary means may be composed of a spring member, so that the auxiliary means is simple and does not require a large installation space. It is possible to gradually apply a required contacting force or a control force to the swing member with elasticity of the spring member, so that an excellent pin operation is obtained. The spring member may contact the swing member with a maximum force larger than the downward momentum applied to the swing member, thereby securely eliminating the factors of the wrong operation described above.

According to the present invention, the lock mechanism may be applied to an opening-closing device. The movable member switches between a closed position for closing an opening of the base member and an open position for opening the opening of the base member. The opening-closing device includes the lock mechanism and urging means for urging the movable member in a direction toward the open position. The lock mechanism includes the cam provided on one of the base member and the movable member and including the swing groove around the roughly heart-shaped projecting portion, and the swing member movably provided on the other of the base member and the movable member and including the pin for tracing along the swing groove.

In the present invention, when the movable member is pushed against a force of the urging means, the movable member is locked at the closed position through the swing groove and the pin. When the movable member is pushed again, the movable member is released and switched from the closed position to the open position. The cam having the swing groove nearly sideways is provided on a sidewall of the base member. The auxiliary means is also provided on the sidewall of the base member for contacting and separating from the swing member to restrict the wrong movement of the swing member.

In the present invention, the opening-closing device has advantages due to the auxiliary means. At the same time, the cam and the auxiliary means are provided on the sidewall of the base member having an enough space for disposing the cam and the auxiliary means, thereby making a design more flexible and making the device small. The movable member may rotate through an arm supported on the sidewall of the base member. The movable member may also include a plate disposed below the arm and moving along the guide groove of the base member. The swing member is connected to the plate. As a result, it is possible to smoothly move the movable member without rattle. It is also possible to move the movable member close to the base member, thereby minimizing an amount of projection of the movable member upon switching.

DETAILED DESCRIPTION OF PREFERRED EMBODIMENTS

Figure 1A:
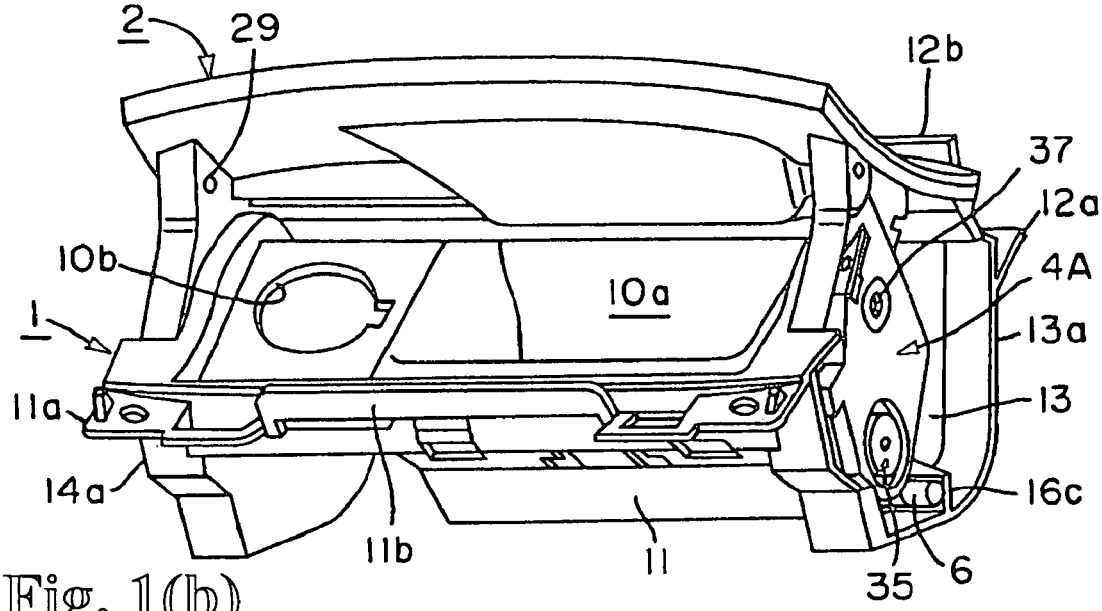
FIGS. 1(*a*) and 1(*b*) are schematic views of a device to which a lock mechanism of the present invention is applied, wherein FIG. 1(*a*) shows a movable member of the device in an open position and FIG. 1(*b*) shows the movable member of the device in a closed position.
Figure 1B:
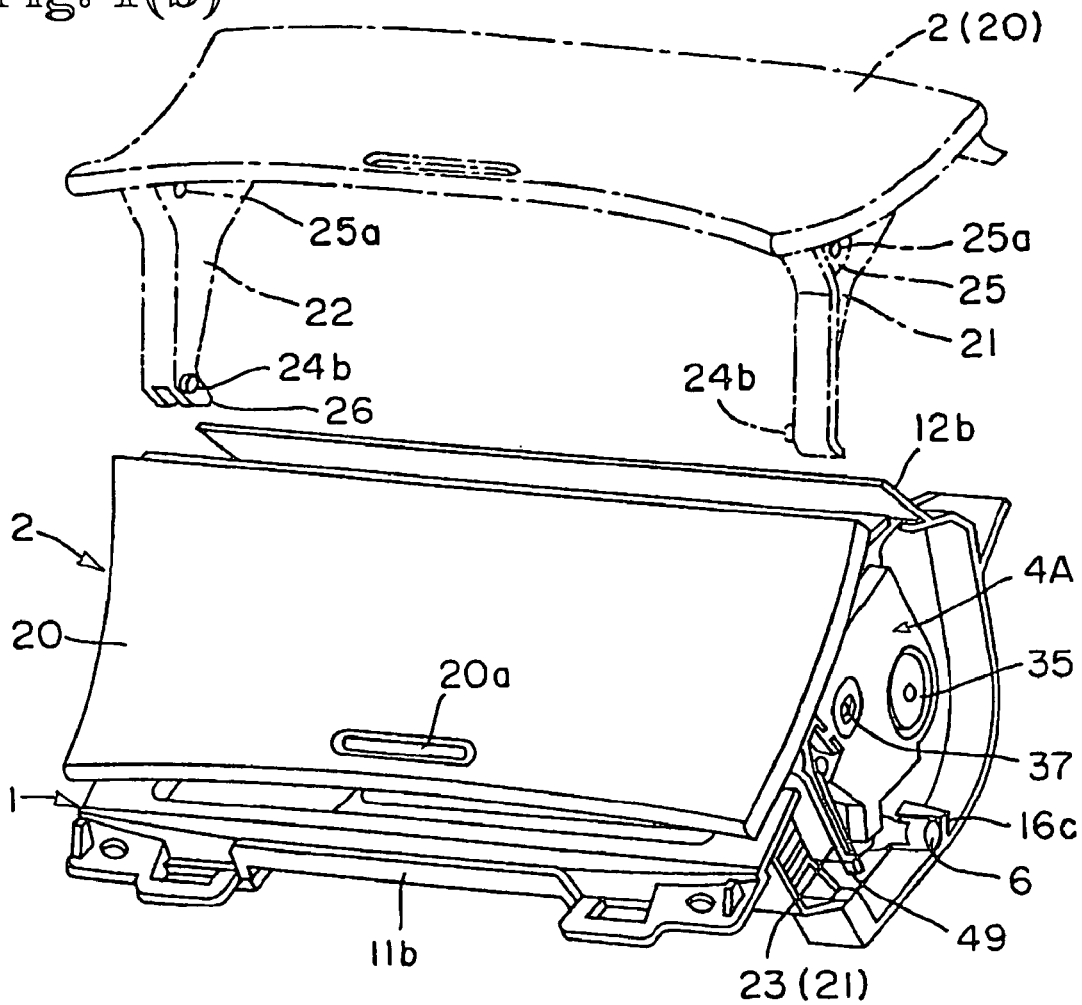

Hereunder, preferred embodiments of the present invention will be explained with reference to the accompanying drawings. FIGS. 1(*a*)–7(*c*) show a lock mechanism of the present invention and an opening-closing device of a movable member including the lock mechanism.

Figure 2A:
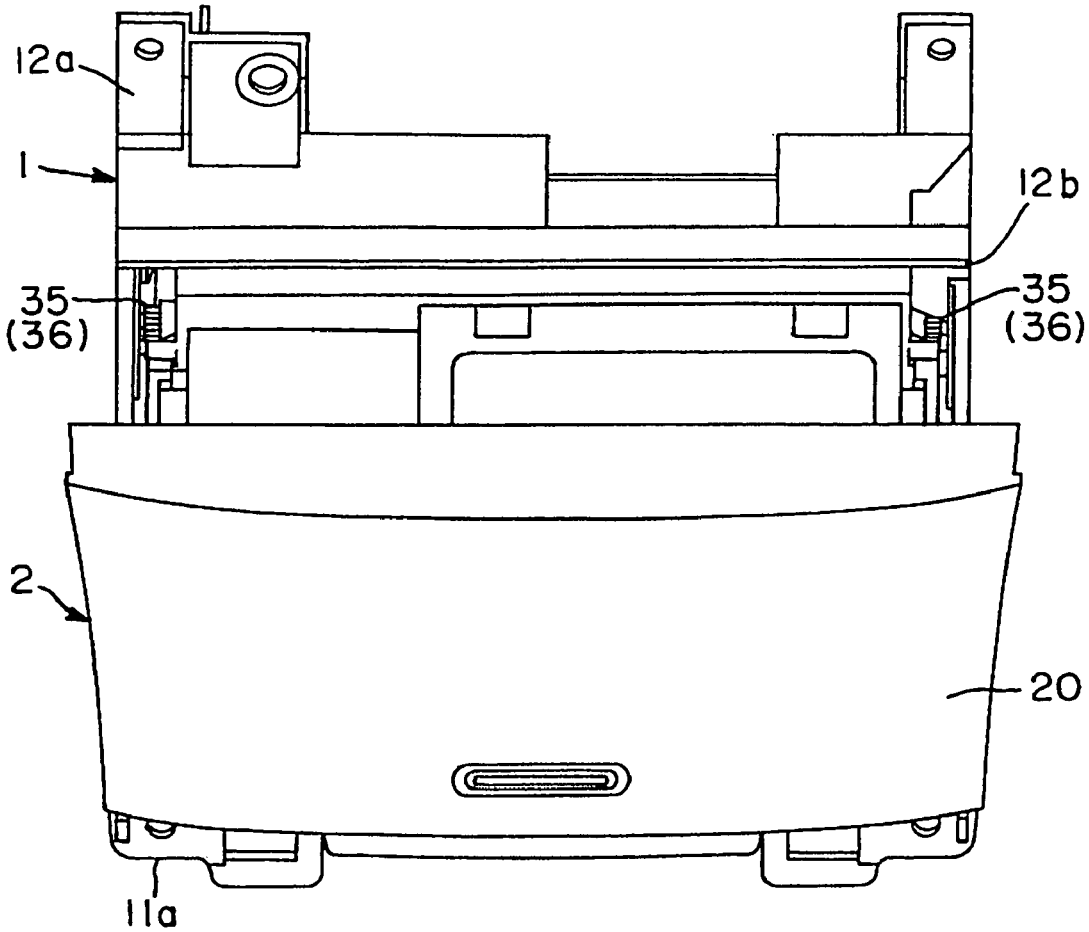
FIGS. 2(*a*) and 2(*b*) are views of the device shown in FIGS. 1(*a*) and 1(*b*) in the closed position, wherein FIG. 2(*a*) is a top view thereof and FIG. 2(*b*) is a front view thereof.
Figure 2B:
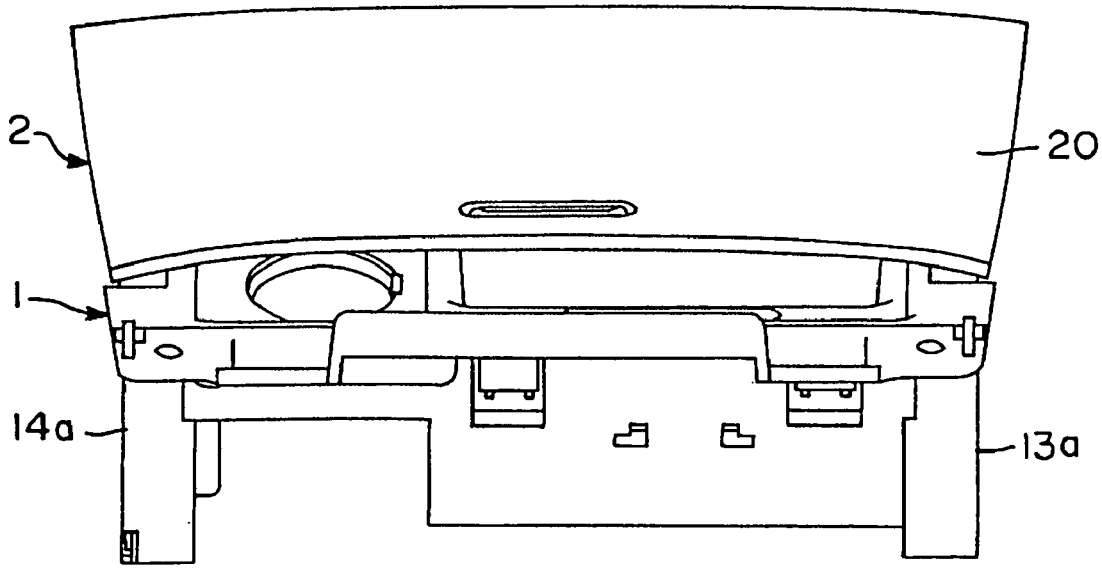
Figure 3A:
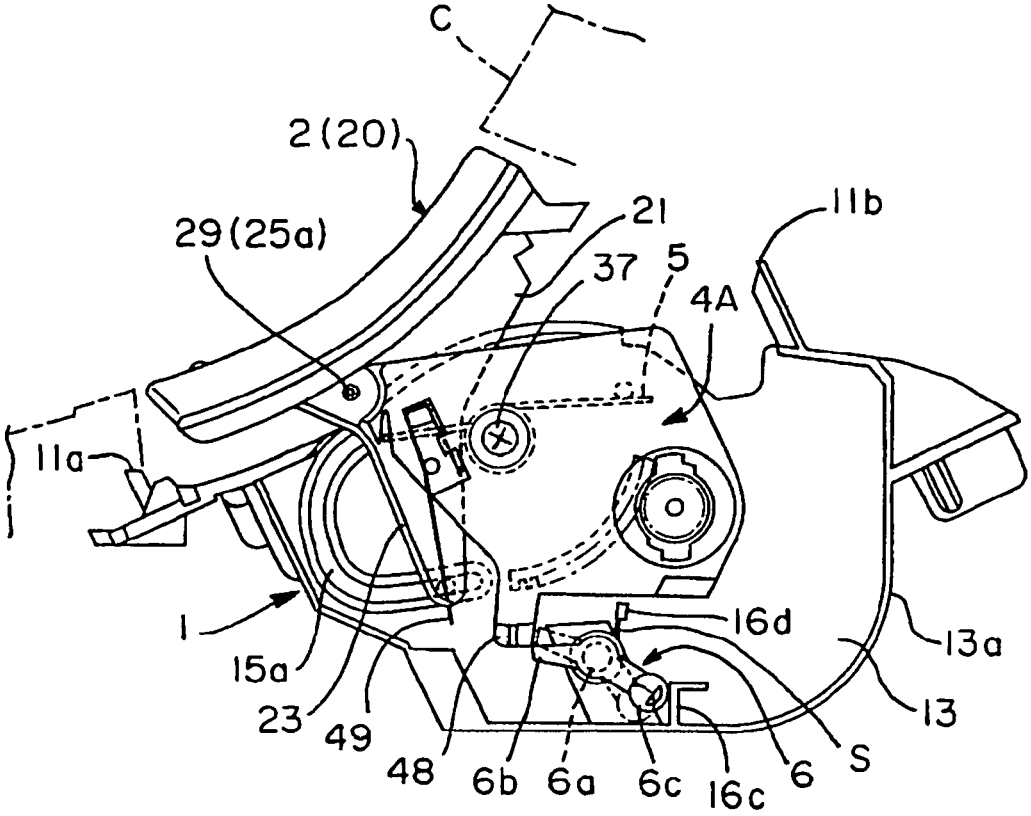
FIGS. 3(*a*) and 3(*b*) are right side views of the device, wherein FIG. 3(*a*) shows the movable member of the device in the closed position and FIG. 3(*b*) shows the movable member of the device in an open position.
Figure 3B:
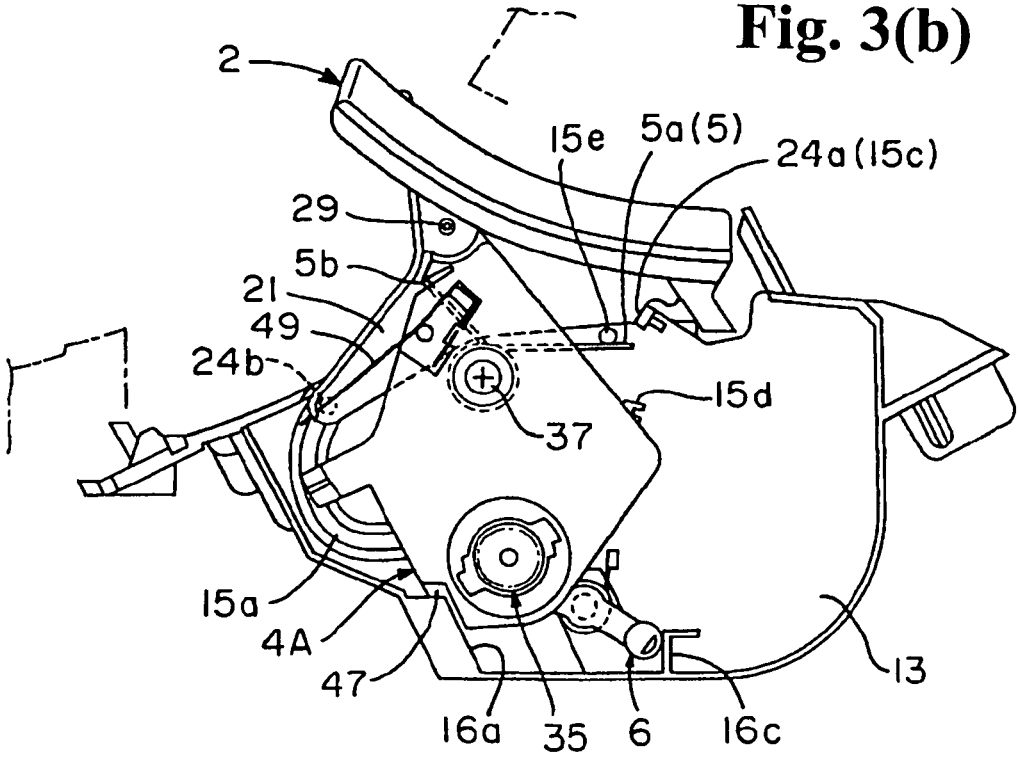

FIGS. 1(*a*) and 1(*b*) are schematic views of a device to which a lock mechanism of the present invention is applied, wherein FIG. 1(*a*) shows a movable member of the device in an open position (the second position) and FIG. 1(*b*) shows the movable member of the device in a closed position (the first position). FIGS. 2(*a*) and 2(*b*) are views of the device shown in FIGS. 1(*a*) and 1(*b*) in a closed position, wherein FIG. 2(*a*) is a top view thereof and FIG. 2(*b*) is a front view thereof. FIGS. 3(*a*) and 3(*b*) are right side views of the device, wherein FIG. 3(*a*) shows the movable member of the device in the closed position and FIG. 3(*b*) shows the movable member of the device in an open position. FIGS.

Figure 4A:
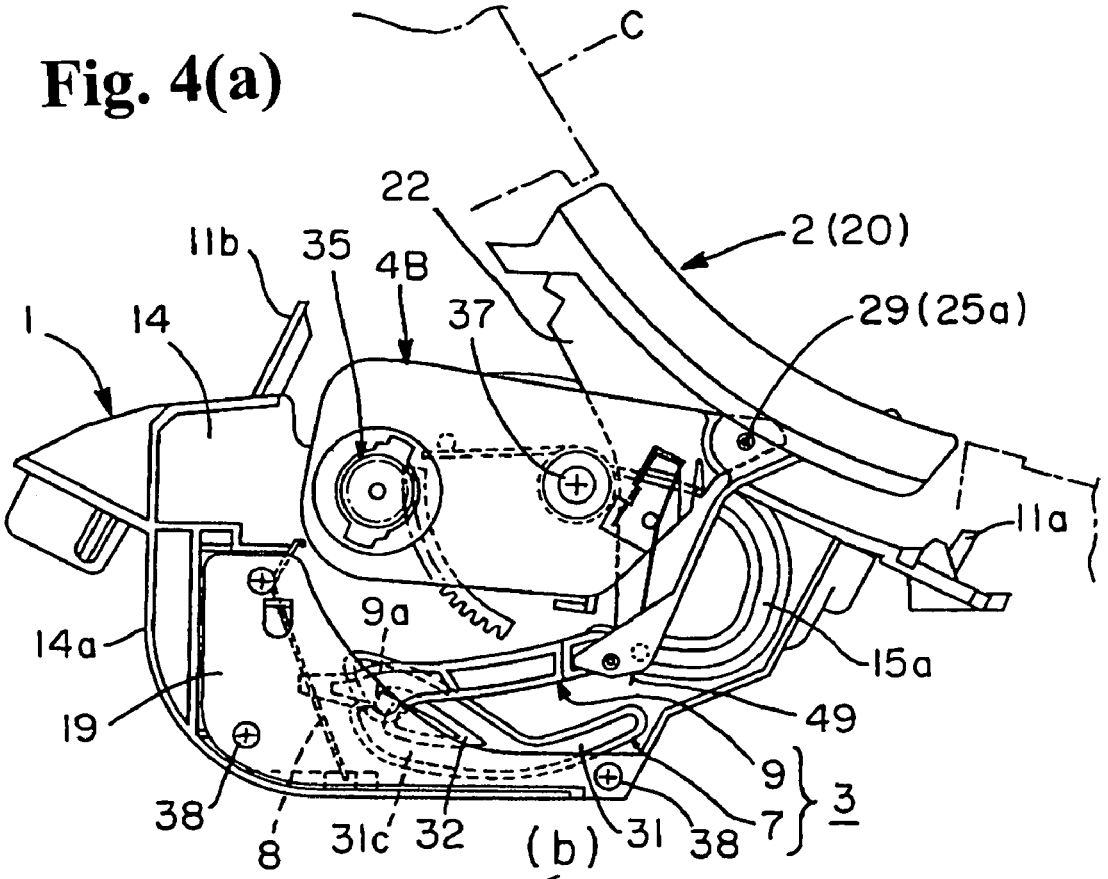
FIGS. 4(*a*) and 4(*b*) are left side views of the device, wherein FIG. 4(*a*) shows the movable member of the device in the closed position and FIG. 4(*b*) shows the movable member of the device in an open position.
Figure 4B:
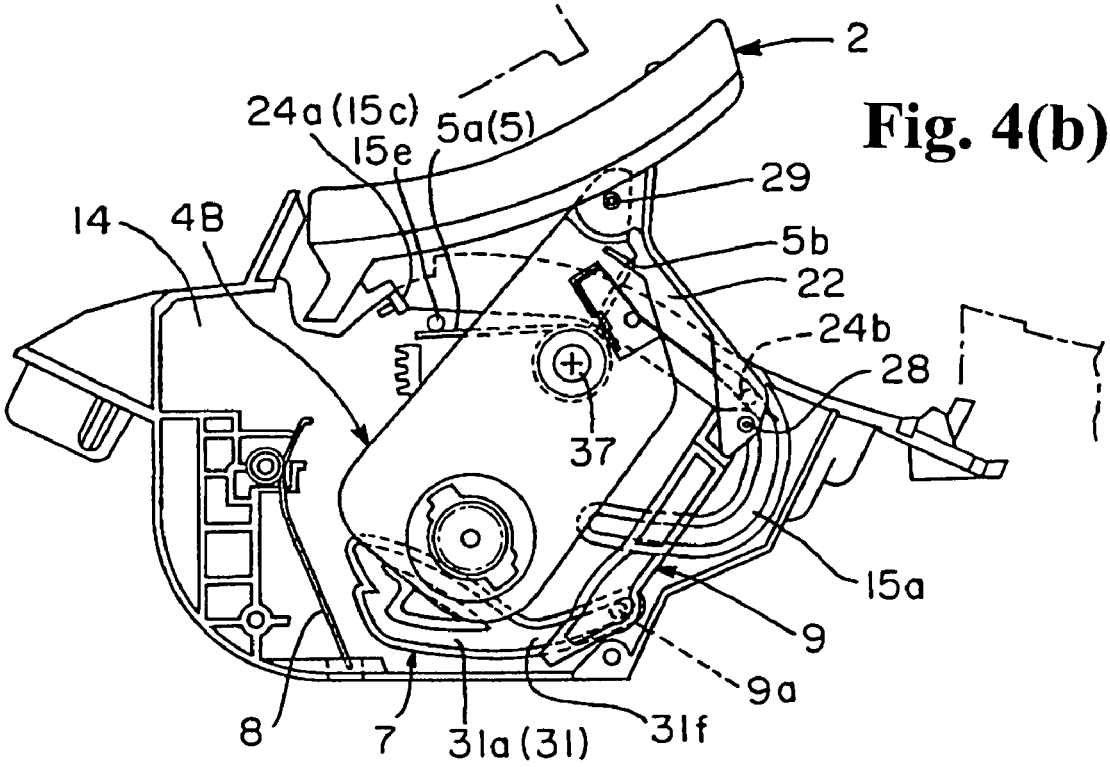
Figure 5A:
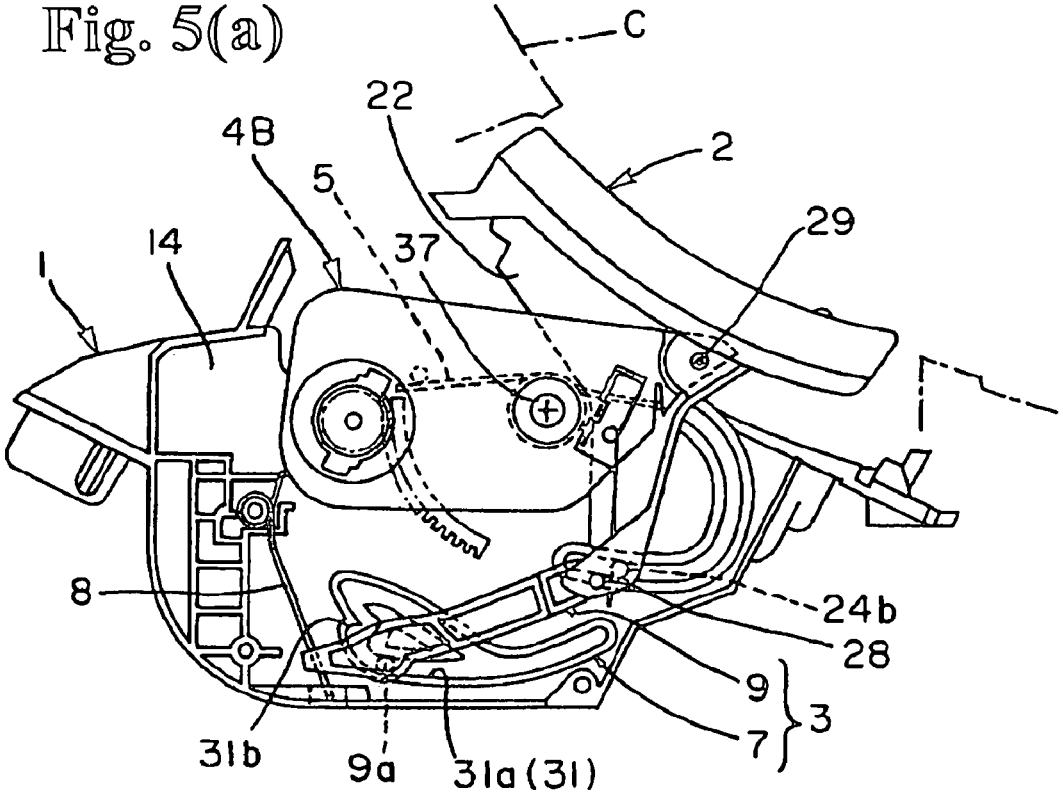
FIGS. 5(*a*) and 5(*b*) are left side views of the device showing an operation of essential parts of the movable member and the lock mechanism.
Figure 5B:
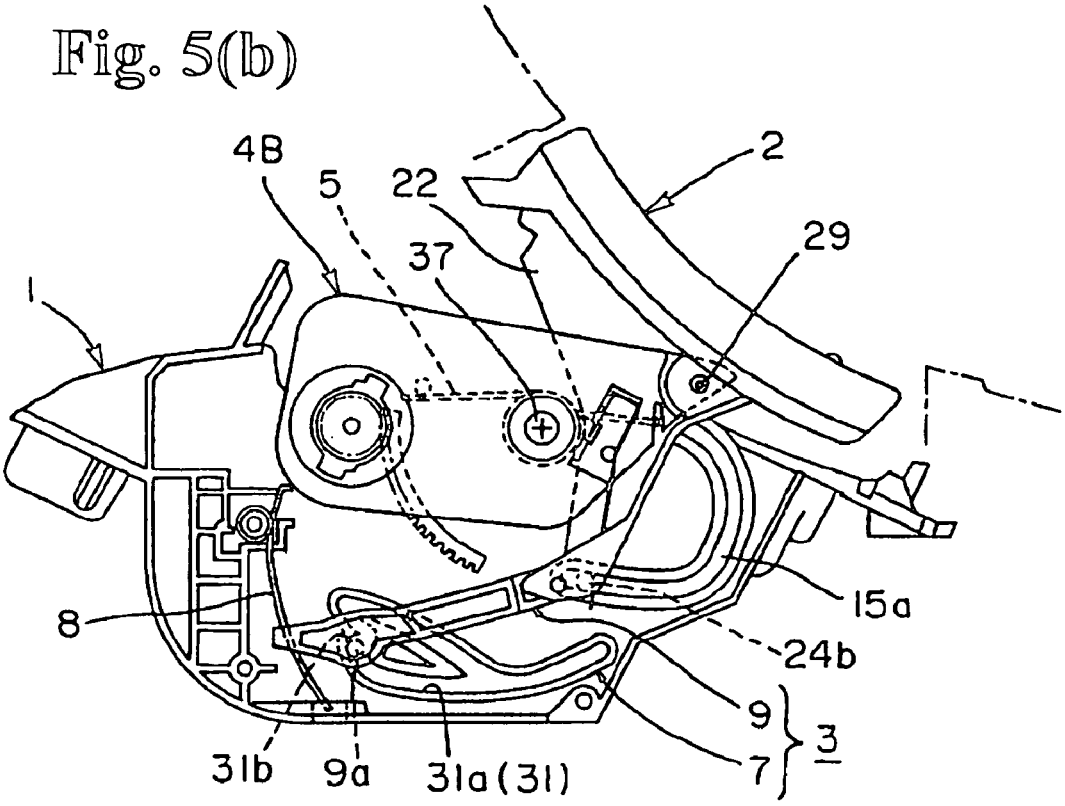
Figure 6A:
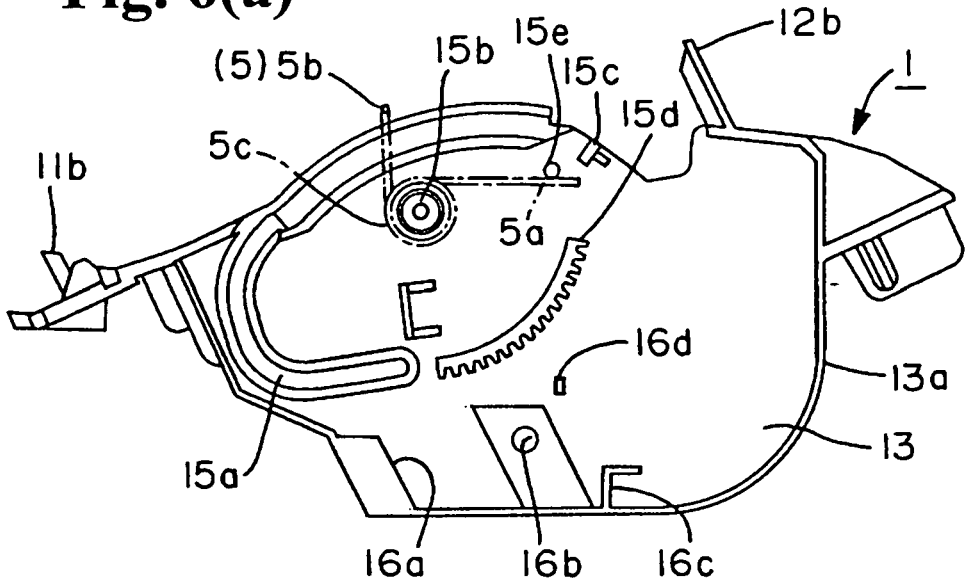
FIGS. 6(*a*)–6(*c*) are exploded structural views showing the device corresponding to FIGS. 3(*a*) and 3(*b*)
Figure 6B:
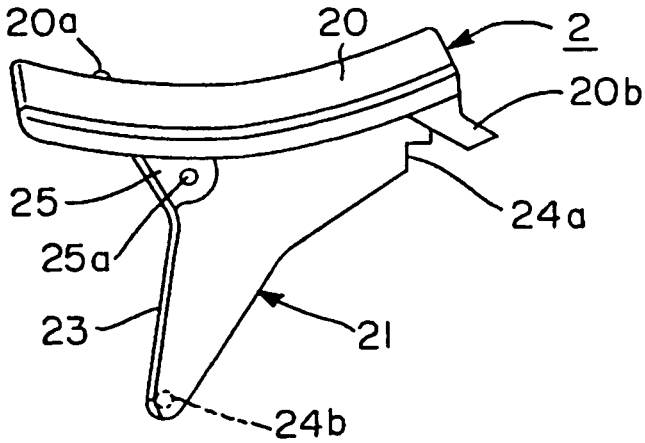
Figure 6C:
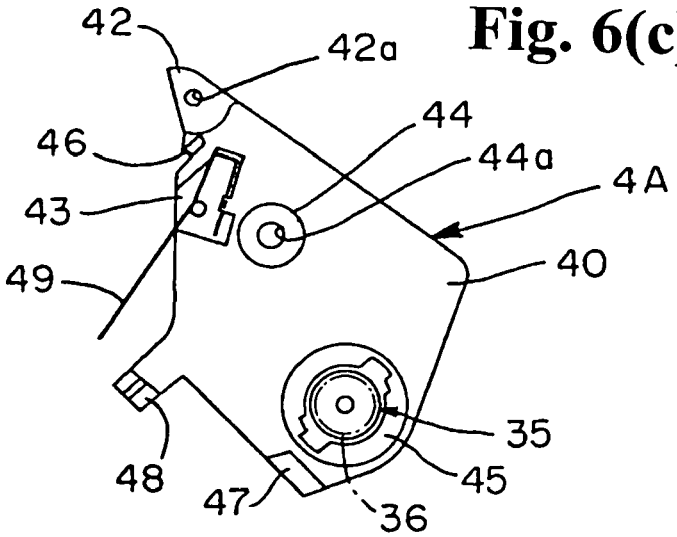
Figure 7A:
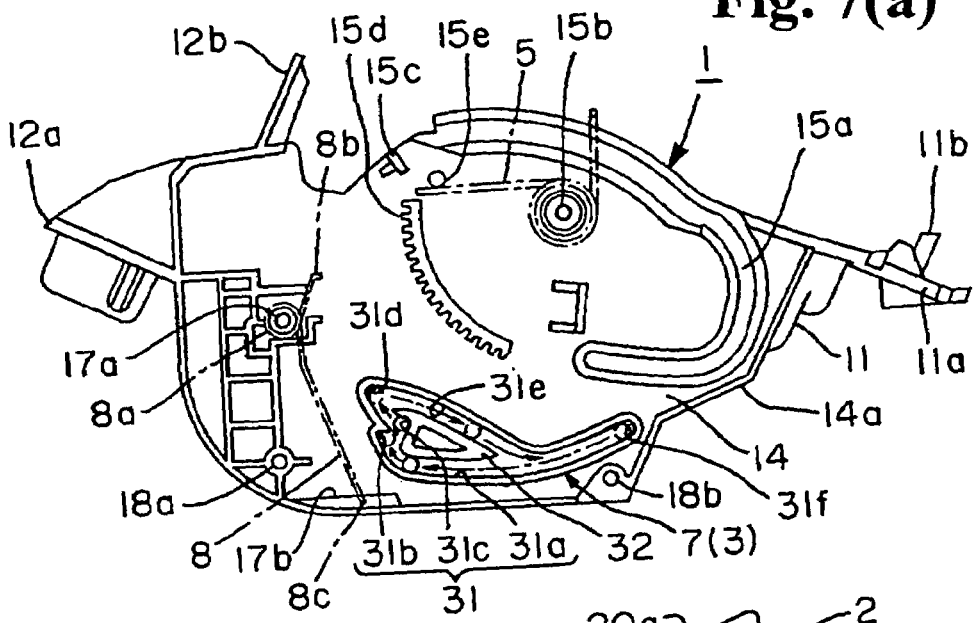
FIGS. 7(*a*)–7(*c*) are exploded structural views showing the device corresponding to FIGS. 4(*a*) and 4(*b*)
Figure 7B:
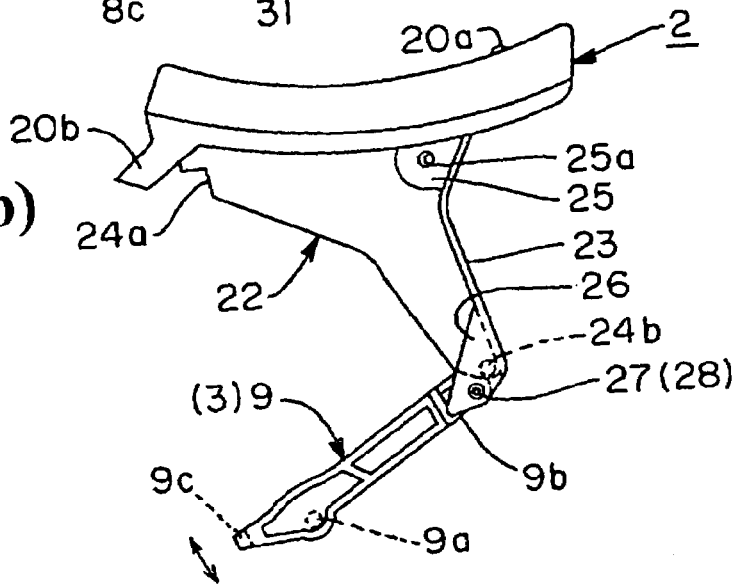
Figure 7C:
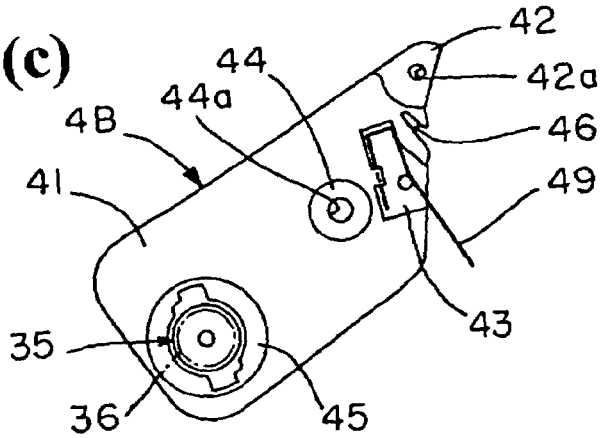
Figure 8A:
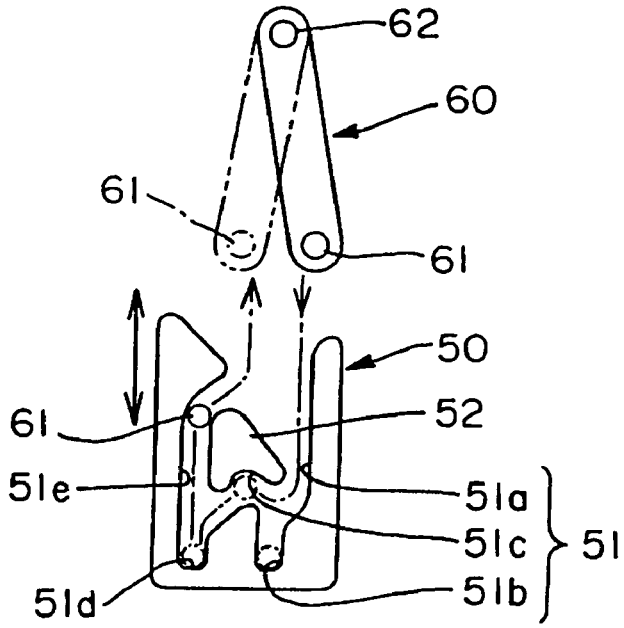
Fig. 8(a) Prior Art
FIGS. 8(*a*)–8(*c*) are views showing conventional lock mechanisms.
Figure 8B:
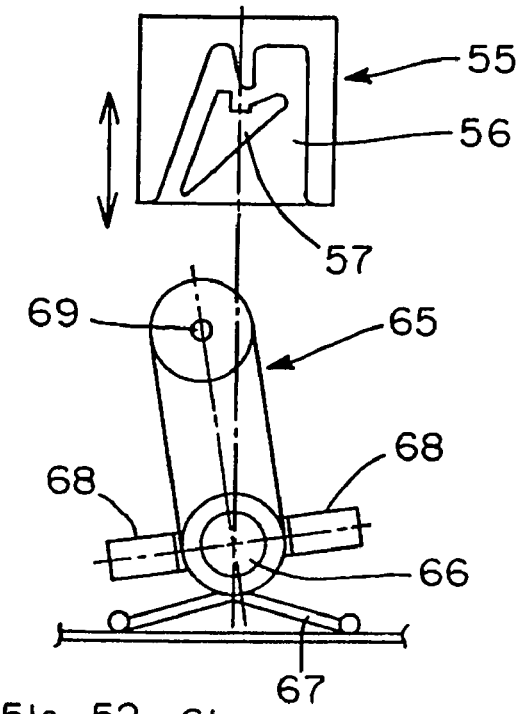
Fig. 8(b) Prior Art
Figure 8C:
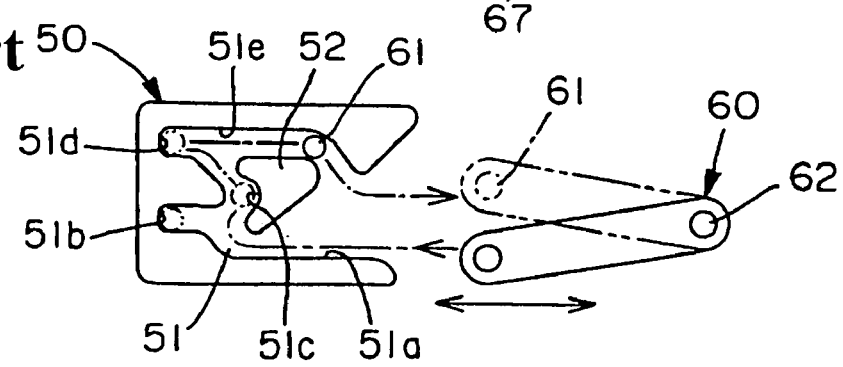
Fig. 8(c) Prior Art

4(*a*) and 4(*b*) are left side views of the device, wherein FIG. 4(*a*) shows the movable member of the device in the closed position and FIG. 4(*b*) shows the movable member of the device in an open position. FIGS. 5(*a*) and 5(*b*) are left side views of the device showing an operation of essential parts of the movable member and the lock mechanism. FIGS. 6(*a*)–6(*c*) are exploded structural views showing the device corresponding to FIGS. 3(*a*) and 3(*b*). FIGS. 7(*a*)–7(*c*) are exploded structural views showing the device corresponding to FIGS. 4(*a*) and 4(*b*).

A structure, assembly, and basic operation of the device including the lock mechanism will be explained in detail, and then an operation of essential parts will be explained.

(Device Structure) According to an embodiment, a base member 1 has an opening, and a movable member 2 opens and closes the opening. A lock mechanism 3 of the present invention or an opening-closing device with the lock mechanism locks and releases the movable member 2. The lock mechanism 3 is a push-push type, and the whole device is installed in a dented place such as a center console C in a car compartment. The opening-closing device switches the movable member 2 between a closed position and an open position relative to the base member 1.

The opening-closing device includes urging means 5; the lock mechanism 3; arms 4A and 4B disposed between the base member 1 and the movable member 2; a G sensor 6 for safely locking the lock mechanism 3 to be released properly when the base member 1 receives a large impact; and damper means 35 for braking a rotation of the movable member 2. The lock mechanism 3 includes a cam 7 and a spring member 8 as auxiliary means provided on the base member 1; and a swing member 9 provided on the movable member 2. The base member 1, the movable member 2, the arms 4A and 4B, and the swing member 9 are formed of a resin, though a material is not limited to the resin.

The base member 1 is defined with front and back walls 11, 12 and sidewalls 13, 14, and has a depressed portion 10*a* used as an ashtray and an insertion hole 10*b* for installing a lighter. The front and back walls 11 and 12 include attachment portions for installation 11*a*, 12*a*, a positioning portion, and standing walls 11*b*, 12*b* projecting upwardly. The sidewalls 13 and 14 have flanges 13*a* and 14*a* around peripheries thereof except a part at an upper side.

The sidewalls 13 and 14 are also symmetrically provided on outer surfaces thereof with roughly C-shaped guide grooves 15*a* for guiding the movable member 2; boss-like attachment portions 15*b* for supporting the arms 4A and 4B; projections 15*c* as an open position stopper; arc-shaped teeth portions 15*d* engaging rotational gears 36 of the damper means 35 (refer to FIGS. 2(*a*), 2(*b*)); and projections 15*e* for engaging ends 5*a* of the urging means 5. Further, the sidewall 13 is provided on the outer surface thereof with a projection for a stopper 16*a* abutting against the arm 4A at the open position of the movable member 2 at a front lower side; an attachment portion 16*b* for the G sensor 6; a standing plate 16*c* projecting adjacent to the attachment portion 16*b*; and a small projection 16*d* (refer to FIGS. 6(*a*)–6(*c*)).

The sidewall 14 is provided on the outer surface thereof with the cam 7 disposed sideways at a lower side; and supporting portions 17*a* and 17*b* disposed behind the cam 7 for supporting the spring member 8. The supporting portion 17*a* is formed in a boss with a hole located above the cam 7, and functions as an attaching portion for attaching a cover 19. The supporting portion 17*b* is formed in a slit hole located below the cam 7. The cover 19 is attached at attaching portions 18*a* and 18*b* as well as the supporting portion 17*a* (refer to FIGS. 4(*a*), 4(*b*) and 7(*a*)–7(*c*)). The cover 19 is shown only in FIG. 4(*a*).

The lock mechanism 3 includes the cam 7, the spring member 8 and the swing member 9. The cam 7 has a swing groove 31 around a projecting portion 32. The projecting portion 32 is roughly a heart-shaped island and has a depression inside the island. The swing groove 31 is a groove between a continuous wall formed on the outer surface of the sidewall 14, and a groove formed between the continuous wall and the projecting portion 32.

More specifically, as shown in FIG. 7(*a*), the swing groove 31 includes a guide groove for introduction 31*a* extending in right-left direction below the projecting portion 32; a guide groove for engagement 31*b* and a guide groove for release 31*d* located behind the guide groove 31*a* (left side in the figure) and dividing up and down; an engagement groove 31*c* located between the guide grooves 31*b* and 31*d* at a side of the projecting portion 32; a return groove 31*e* extending almost horizontally from the guide groove 31*d*; and a shelter groove 31*f* located on a front side of the guide groove 31*a* and the return groove 31*e* (right side in the figure).

The spring member 8 is a torsion spring including a coil portion 8*a* at an upper side. A lower end 8*c* of the spring member 8 is inserted in a hole of the supporting portion 17*b* with play relative to the sidewall 14. The coil portion 8*a* is supported in order to fit into the boss periphery of the supporting portion 17*a*. An upper end 8*b* of the spring member 8 engages a corresponding rib provided on an upper side of the supporting portion 17*a*, so that the spring member 8 is fixed when the cover 19 is attached.

When the spring member 8 is attached, a part of the spring member between the coil portion 8*a* and the lower end 8*c* faces at least between the guide groove 31*a* and the guide groove 31*d* of the swing groove 31. Also, the spring member 8 is arranged in an inclined state so that the spring member 8 approaches the swing groove 31 upwardly along the part of the spring member between the coil portion 8*a* and the lower end 8*c*. In the embodiment, the spring member 8 is the linear spring, however, a plate spring may be used.

The urging means 5 are temporarily attached to the sidewalls 13 and 14, and the G sensor 6 is attached to the sidewall 13. Each of the urging means 5 is a torsion spring in which a middle part of the coil portion 5*c* is fitted on a periphery of the boss-shaped attachment portion 15*b* and one end 5*a* engages the projection 15*e*, so that the urging means 5 are temporarily attached (refer to FIG. 6(*a*)).

The G sensor 6 includes an attachment portion 6*a* situated at roughly the middle thereof and forming a clip inside; and a contacting portion 6*b* and a loading portion 6*c* provided on both sides of the attachment portion 6*a*. In the G sensor 6, the attachment portion 6*a* is rotatably supported on the attachment portion 16*b* of the sidewall 13, and a spring S urges the G sensor 6. The spring S is held on a periphery of the attachment portion 16*a* in which one end of the spring S engages a small projection 16*d* and the other end thereof engages the loading portion 6*c*, so that the spring S urges the G sensor 6 to rotate counterclockwise around the attachment portion 6*a*. The loading portion 6*c* abuts against the standing plate 16*c* with the urging force to hold the G sensor 6 (refer to FIG. 3(*a*)).

The movable member 2 may be a lid, door, or cover, and includes a portion 20 covering an upper side of the base member 1; and plates 21 and 22 extending downwardly from both sides of the portion 20 and disposed at an outside of the sidewalls 13 and 14 of the base member 1. A small projection 20*a* for applying a finger is provided on a front outer surface of the portion 20. The plates 21 and 22 include symmetrically brims 23 projecting on front upper and lower edges of the plates 21 and 22; steps 24*a* provided on back upper sides of the plates 21 and 22; projecting portions 24*b* projecting to lower inner sides of the plates 21 and 22 and fitting into the guide grooves 15*a* of the base member 1; and small projecting plates 25 with an axial hole 25*a* located on the front upper side of the plates 21 and 22 and integrated with the brims 23 for maintaining a gap between the corresponding plates 21 and 22, respectively.

A supporting portion 26 with an axial hole 27 is formed on the plate 22 at a lower side thereof, and is integrated with the brim 23 for maintaining a gap between the plate 22 and the supporting portion 26 (refer to FIG. 7(*b*)). The swing member 9 composing the lock mechanism 3 is supported on the supporting portion 26.

The swing member 9 is formed in a form of an elongated plate, and includes a pin 9*a* projecting at a side facing the cam 7 of the base member 1 slightly before an edge; an axial hole (not shown) provided on a base end 9*b*; and a depressed portion 9*c* with an opening at a front provided at an edge. In the swing member 9, the base end 9*b* thereof is disposed between the supporting portion 26 and the opposed part of the plate 22 relative to the plate 22 of the movable member 2. The swing member 9 is movably supported through the axis 28 such as a locking pin inserted from the axial hole 27. The movable member 2 is rotatably supported relative to the base member 1 through the arms 4A and 4B.

Each of the arms 4A and 4B is made of an irregular shaped thin plate, and includes a connecting portion 42 with an axial hole 42*a* provided on an upper side corner as a thin plate and disposed in a gap between a projecting plate 25 and the plate 21 or 22 corresponding thereto; a depressed portion 43 for a leaf spring provided slightly below the connecting portion 42; a depression 44 corresponding to each attachment portion 15*b* of the base member 1; an attachment hole 44*a* passing through the center of the depression 44; an attachment portion 45 for the damper means; and a depressed portion 46 engaging a corresponding end 5*b* of the urging means 5. The arm 4A is further provided with a control portion 47 located on a front lower side thereof and contacting the projection 16*a* of the base member 1 in the open position of the movable member 2; and a projecting plate 48 located on an upper side of the control portion 47 adjacent to the contacting portion 6*b* of the G sensor 6 in the open position of the movable member 2 (refer to FIGS. 3(*a*), 3(*b*), 6(*c*)).

The damper means 5 are attached to the attachment portions 45, and the leaf springs 49 are attached to the depressed portions 43. The damper means 5 include rotational gears 36 held in cases (refer to FIG. 2(*a*)). When the damper means 5 is installed to the attachment portion 45, the rotational gear 36 projects to an inside of the arm and engages the corresponding teeth portion 15*d*. The damper mechanism consists of a well-known rotary oil damper, in which the rotating gear 36 is damped through resistance of the operating oil in the case, and other types may be used. The leaf spring 49 includes a roughly U-shaped base portion. When the base portion is installed in the depressed portion 43 in a restricted state, an edge of the leaf spring 49 projects downwardly below the depressed portion 43.

(Assembly and basic operation) The arms 4A and 4B are attached to the base member 1 with the movable member 2 after the arms 4A and 4B are connected to the corresponding plates 21 and 22 of the movable member 2. First, each of the connecting portions 42 is inserted into the small projecting plate 25, and the axis 29 such as a locking pin is pressed into a hole provided on each of the plates 21 and 22 through the axial holes 25*a* and 42*a*, so that the arms 4A and 4B are movably connected to the sidewalls 13 and 14 of the movable member 2. In this case, the leaf spring 49 of the arm 4A is disposed such that an edge of the leaf spring 49 contacts an inner lower end of the brim 23. The leaf spring 49 of the arm 4B is disposed such that an edge of the leaf spring 49 contacts the base end 9*b* of the swing member 9 disposed between the supporting portion 26 and the opposed part of the plate 22 from the inside of the brim 23. Each of the leaf springs 49 absorbs rattle between the arms 4A and 4B and the plates 21 and 22.

Next, each of the arms 4A and 4B is positioned on the sidewalls 13 and 14, and a screw 37 engages the attachment portion 15*b* of each of the corresponding sidewalls 13 and 14 through the attachment hole 44*a*, so that the movable member 2 is attached to the base member 1. The ends 5*a* of the urging means 5 are taken off from the projections 15*e*, and the other ends 5*b* thereof are hooked at the depressed portions 46 of the arms 4A and 4B, while the arms 4A and 4B are attached. Then, the ends 5*a* engage the projections 15*e* while the urging force is increased. Next, the cover 19 is mounted. The cover 19 prevents the spring member 8 from coming off.

In the assembled state, the movable member 2 automatically rotates from the closed position shown in FIGS. 3(*a*) and 4(*a*) to the open position shown in FIGS. 3(*b*) and 4(*b*) with the force of the urging means 5 around the screws 37 of the arms 4A and 4B. When the movable member 2 is closed, the movable member 2 moves toward the closed position against the force of the urging means 5. When the movable member 2 moves, the plates 21 and 22 are rotatably supported through the axes 29 relative to the arms 4A and 4B, and each of the projecting portions 24*b* of the plates moves along each of the guide grooves 25. Accordingly, when the movable member 2 switches the positions, the movable member 2 moves close to the base member 1, thereby minimizing an amount of projection or extension of the movable member 2.

Further, the rotational gears 36 of the damper means 35 engage the tooth portions 15*d* on the sidewalls 13 and 14. Accordingly, when the movable member 2 moves, a rotational speed is damped through the damper means 35, and the movable member 2 always rotates at a constant speed from the closed position to the open position. The movable member 2 is urged and rotates toward the open position until both steps 24*a* hit the corresponding projections 15*c* of the base member. In the open position, the movable member 2 moves into a depressed place such as the center console C, so that the movable member 2 does not become an obstacle and a good appearance is obtained.

(Operation of substantial part) An operation of the lock mechanism 3 will be explained next. When the movable member 2 is in the open position, the pin 9*a* of the swing member 9 is in the shelter groove 31*f* of the swing groove 31 of the cam 7. The movable member 2 is pushed to move from the open position toward the closed position against the force of the urging means 5. In this process, the swing member 9 gradually changes a position thereof from a steep inclined state shown in FIG. 4(*b*) to a horizontal state shown in FIGS. 5(*a*) and 5(*b*). The pin 9*a* moves from the shelter groove 31*f* to the guide groove 31*a*, and to the guide groove 31*b*.

When the pin 9*a* reaches slightly before the guide groove 31*b*, the edge of the depressed portion 9*c* elastically contacts the corresponding portion of the spring member 8, and the swing member 9 receives a reaction force or an urging force (hereinafter referred to as a contacting force) of the spring member 8. The contacting force gradually increases until the pin 9*a* reaches the guide groove 31*b*, so that the swing member 9 doe not move downwardly by its own weight.

When the swing member 9 is released, the movable member 2 tries to rotate toward the open position with the force of the urging means 5. The pin 9*a* enters the engagement groove 31*c* from the guide groove 31*b* and the movable member 2 is locked. Due to the engagement, the movable member 2 is held at the closed position.

In this embodiment, the spring member 8 urges the swing member 9 with the maximum contacting force larger than the downward momentum applied to the center of gravity of the swing member 9 (load that the swing member 9 tries to rotate around the axes 28 by its own weight). As a result, it is possible to prevent a wrong operation due to the weight of the swing member 9. Further, in a case that the cam 7 is provided on the base member 1 with the swing groove 31 arranged sideways, the spring member 8 urges the swing member 9 with the maximum contacting force slightly before the pin 9*a* reaches the engagement groove 31*c* of the swing groove 31 where the movable member 2 is locked in the closed position against the force of the urging means 5. Accordingly, it is possible to reduce a load to the pin 9*a*, thereby obtaining a smooth pin operation.

When the movable member 2 is to switch to the open position, the movable member 2 is pushed again and the pushing force is released, so that the pin 9*a* enters the guide groove 31*d* from the engagement groove 31*c* and returns to the shelter groove 65*f* through the return groove 65*e* from the guide groove 31*d*. Accordingly, the movable member 2 automatically rotates to switch to the open position by the urging means 5. In this structure, in the process that the pin 9*a* reaches the guide groove 31*d* through the engagement groove 31*c*, the edge of the depressed portion 9*c* of the swing member 9 elastically contacts the corresponding portion of the spring member 8 and receives the contacting force of the spring member 8. The contacting force is released when the pin 9*a* moves to the return groove 65*e* from the guide groove 31*d*.

When an impact is applied to the base member 1 through an auto body due to a car accident, the lock mechanism 3 may release the engagement in a wrong operation. In the case that the engagement is improperly released, the movable member 2 automatically rotates to the open position, thereby causing danger. In the structure of the invention, when the movable member 2 receives a large load due to a car accident while being in the closed position, the G sensor 6 rotates clockwise against the force of the spring S. Accordingly, the contacting portion 6*b* moves from a position represented by the solid line in FIG. 3(*a*) to a position represented by the hidden line and hits the projecting plate 48, thereby restricting the movement of the arm 4A. Therefore, the movable member 2 is locked at the closed position, thereby preventing the lock mechanism 3 from releasing improperly.

The embodiments described above do not limit the scope of the present invention. In the invention, it is sufficient that the movable member 2 switches between the first position where the movable member 2 is locked against the force of the urging means 5 relative to the base member 1 and the second position by the force of the urging means 5. While the first position is the closed position, the second position may be a half-opened position.

As explained above, according to the present invention, in the lock mechanism and the opening-closing device of the movable member, it is possible to reliably prevent the above-mentioned factors contributing to the wrong operation with the simple auxiliary means. Further, the auxiliary means is provided at the location where the cam is located, thereby making the disposed space flexible. Therefore, even when the swing member is provided on the movable member, it is possible to prevent the factors contributing to the wrong operation of the pin without making the mechanism portion complicated or restricting the disposed space, thereby making the design flexible and expanding the application.

While the invention has been explained with reference to the specific embodiments of the invention, the explanation is illustrative and the invention is limited only by the appended claims.

What is claimed is:

1. A lock mechanism for locking a movable member to a base member, comprising:

a cam fixed on the base member, and having a projection with a roughly heart shape and a swing groove formed around the projection, a swing member provided on the movable member to move laterally and vertically relative to the cam, and having a tip and a pin close to the tip for tracing the swing groove, and a spring member as auxiliary means provided on the base member and contacting the swing member while the pin is tracing the swing groove so that the auxiliary means allows the swing member to move properly, said spring member being located adjacent to the cam and contacting the tip of the swing member when the swing member is moved close to the projection, to thereby urge the swing member from one side of the projection toward the other side of the projection.

2. A lock mechanism according to claim 1, further comprising urging means for urging the movable member relative to the base member so that the movable member is stopped at a first position through an engagement of the pin and the projection by pushing the movable member against a force of the urging means, and the engagement is released by pushing the movable member again to allow the movable member to move to a second position.

3. An opening-closing device comprising said movable member, said base member, said lock mechanism, and said urging means according to claim 2, wherein the movable member is switched between the first position where the movable member closes an opening of the base member and the second position where the opening is opened, and said cam is arranged to face laterally.

4. An opening-closing device of the movable member according to claim 3, further comprising arms rotatably attached to side walls of the base member, said movable member being rotatably attached to the arms and having a plate extending downwardly therefrom and moving along grooves formed on the side walls, said plate being pivotally connected to the swing member.

5. A lock mechanism according to claim 1, wherein said spring member contacts the swing member with a force larger than a momentum applied to the swing member downwardly.

6. A lock mechanism according to claim 5, wherein said cam is arranged to face laterally so that the spring member pushes the swing member upwardly.

7. A lock mechanism for locking a movable member to a base member, comprising:

a cam fixed on the base member, and having a projection with a roughly heart shape and a swing groove formed around the projection, a swing member provided on the movable member to move laterally and vertically relative to the cam, and having a tip and a pin close to the tip for tracing the swing groove, and a spring member as auxiliary means provided on the base member and contacting the swing member while the pin is tracing the swing groove so that the auxiliary means allows the swing member to move properly, said spring member being located adjacent to the cam and contacting the tip of the swing member when the swing member is moved close to the projection, to thereby urge the swing member from one side of the projection toward the other side of the projection, wherein said spring member is arranged such that when the pin does not engage the cam, the spring member does not contact the swing member.

8. A lock mechanism according to claim 7, wherein said spring member is attached to the base member at a side away from the swing member so that the spring member contacts the swing member to urge obliquely when the pin engages the cam.

9. A lock mechanism according to claim 8, wherein said spring member is a linear or plate spring and is arranged in an inclined state relative to the base member.

* * * * *